United States Patent [19]

Shaw

[11] 4,320,377

[45] Mar. 16, 1982

[54] ARC GAS CONTROL DEVICE FOR A POWER CLASS FUSE HAVING LOAD BREAK CONTACTS

[75] Inventor: J. Howard Shaw, Racine, Wis.

[73] Assignee: McGraw-Edison Company, Rolling Meadows, Ill.

[21] Appl. No.: 248,993

[22] Filed: Mar. 30, 1981

[51] Int. Cl.[3] ..... H01H 85/38

[52] U.S. Cl. ..... 337/278; 200/144 R

[58] Field of Search ..... 337/273, 278, 280, 282, 337/180, 181, 194, 202, 207

[56] References Cited

U.S. PATENT DOCUMENTS

| | | | |
|---|---|---|---|
| 1,919,987 | 7/1933 | Prince | 337/373 X |
| 2,662,138 | 12/1953 | Linoell et al. | 337/282 |
| 3,732,517 | 5/1973 | Keto et al. | 337/382 X |
| 3,984,651 | 10/1976 | Lewis et al. | 200/144 C |
| 4,001,750 | 1/1977 | Scherer et al. | 337/282 X |
| 4,059,816 | 11/1977 | Bonecutter et al. | 337/273 X |

*Primary Examiner*—George Harris

*Attorney, Agent, or Firm*—Ronald J. LaPorte; Jon Carl Gealow; Charles W. MacKinnon

[57] ABSTRACT

A power class fuse comprises an insulative canister having a female load break contact at a closed end of the canister and a male load break contact, coupled electrically to a fuse element. The male load break contact is inserted into the canister for engagement with the female load break contact to complete a circuit through the fuse element. An arc gas control device including a pair of spaced parallel plates each having apertures formed therethrough and filter material sandwiched between the plates, is mounted on the male load break contact. The arc gas control device forms a partition in the canister upon insertion of the male load break contact thereinto. Arc gas generated upon engagement of the male and female load break contacts passes through the control device into the canister interior surrounding the fuse element to reduce back pressure in the canister, while metallic particles and other contaminants which could produce flashovers within the canister, are trapped in the filter material.

8 Claims, 4 Drawing Figures

ARC GAS CONTROL DEVICE FOR A POWER CLASS FUSE HAVING LOAD BREAK CONTACTS

BACKGROUND OF THE INVENTION

This invention relates generally to high voltage power class fuses which include load break contacts and more particularly to such fuses which include means for controlling the effects of arc gases created upon manual engagement and disengagement of the load break contacts.

High voltage power class fuses of the type which include load break contacts are most often used to protect high voltage electrical devices, such as, for example, transformers, from excessive electrical loads.

Normally the load break contacts of a power class fuse are mechanically closed and create little if any arc and resulting gases. However, when the load break contacts are closed under fault conditions through the manual insertion of one of the load break contacts into an insulative canister of the fuse, hot arc gases are generated. These arc gases not only create a pressure within the canister, which tends to prevent closure of the contacts, but the gases also contain contaminants such as, for example, metallic particles, which could disrupt the operation of the fuse element of the fuse.

A variety of prior art devices have been included in fuse canisters to control, in some manner, the gases created by the arc produced upon manual closure of the load break contacts. U.S. Pat. No. 3,732,517, issued May 8, 1973, discloses an arc snuffing device including a spring loaded member which closes a deionizing chamber about one of the contacts following separation thereof. In U.S. Pat. No. 3,984,651, issued Oct. 5, 1976, and assigned to the same assignee as the instant invention, a grooved, insulating sleeve is included in the fuse canister to channel arc gases generated for the promotion of turbulence therein and thereby cool the gases. An insulative barrier mounted on the insertable load break contact restricts the gases in the canister to the space surrounding the mated contacts.

In still another U.S. Pat. No. 4,059,816, issued Nov. 22, 1977, and assigned to the same assignee as the instant invention, there is included a load break fuse in which a non-conductive sleeve and collar is formed about the fuse element. A load break contact probe having a non-conductive tip is provided at the inner end of the fuse element. A non-conductive disc is mounted between the fuse element and contact probe. The sleeve, collar and disc serve to diffuse and cool ionized gases generated by arcing between the load break contacts within the canister.

While the above described devices all have been designed to control, in some fashion, hot arc gases created upon engagement of the load break contacts in a power class fuse, each is somewhat complicated and/or requires a plurality of components, adding to the cost thereof. Furthermore, these devices do not control metallic particles and other contaminants normally found in the arc gases when they are generated.

SUMMARY OF THE INVENTION

Accordingly, it is a primary object of the present invention to provide in a canister-type power class fuse employing load break contacts, an improved device for controlling hot arc gases created upon the manual engagement of such load break contacts.

It is another object of the present invention to provide a device of the above described type which is simple in construction, relatively inexpensive, and yet efficient to control hot arc gases created in the fuse canister.

It is still another object of the present invention to provide a new and improved device for use in the canister of a power class fuse which not only controls hot arc gases created therein upon the manual closure of the load break contacts, but which also disposes of metallic particles and other contaminants contained in the gases.

Briefly, a power class fuse including an arc gas control device according to the invention comprises a cylindrical fuseholder or canister formed of electrical insulating material. The canister has a first closed end and a second open end. A female load break contact is positioned inside the canister adjacent the closed end thereof and receives an elongated male load break contact located at a leading end of a current limiting fuse element assembly to be inserted into the canister. When the fuse element assembly including the male load break contact is inserted into the canister to engage the female load break contact, thereby completing an electrical circuit through the fuse element, an arc is created between the load break contacts, generating hot gases which contain electrically conductive particles. The control device according to the invention is secured to the leading end of the male load break contact. When mounted on the inserted fuse element assembly, the control device slideably engages the interior walls of the canister thereby to form a barrier or partition to withstand migration toward the fuse element of the conductive gaseous arc products produced upon closure of the load break contacts.

The control device comprises two parallel spaced apart, perforated plates having fiberglass or similar filter material disposed therebetween. The device is dimensioned for receipt in the interior of the canister to form the aforementioned partition or barrier across the width of the canister. The perforated plates permit hot gases to expand through the device into the area surrounding the fuse element, while trapping metallic particles and other arc products within the filter material.

Thus, gases generated by the arc established between the load break contacts are not confined to the interior of the canister surrounding the contacts, but rather are permitted to expand throughout the entire volume of the canister, thereby effectively minimizing any back pressure which could hinder the complete insertion of the fuse element assembly into the canister. Arc products, such as metallic particles and the like, present in the arc gases, are captured in the filter material and thus prevented from causing a malfunction in the fuse.

DETAILED DESCRIPTION OF THE DRAWINGS

Figure 1:
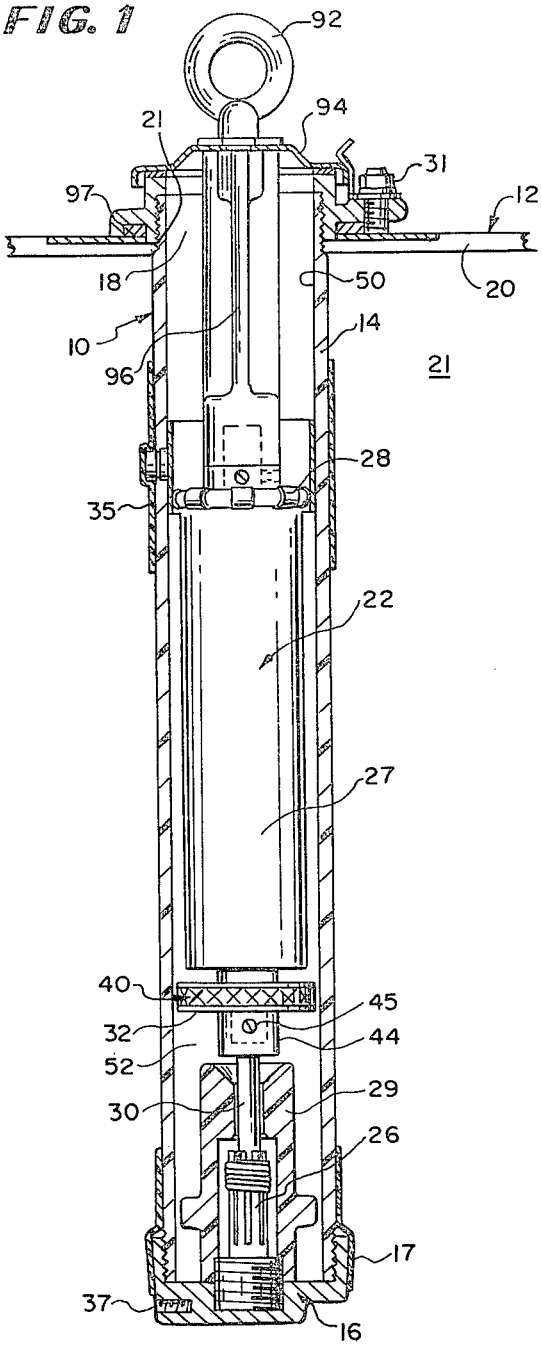
FIG. 1 is a cross-sectional view of a power class fuse including load break contacts and a new and improved arc gas control device according to the invention.
Figure 2:
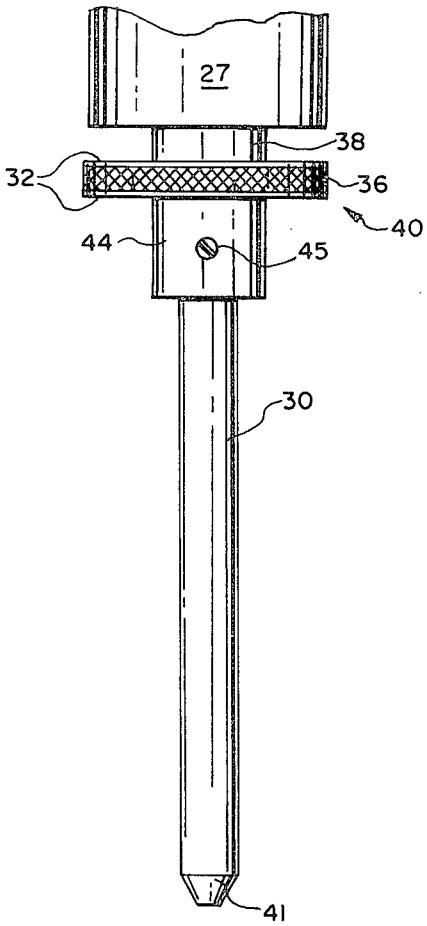
FIG. 2 is an enlarged side view of a male load break contact included in the fuse of FIG. 1 and arc gas control device according to the invention.
Figure 3:
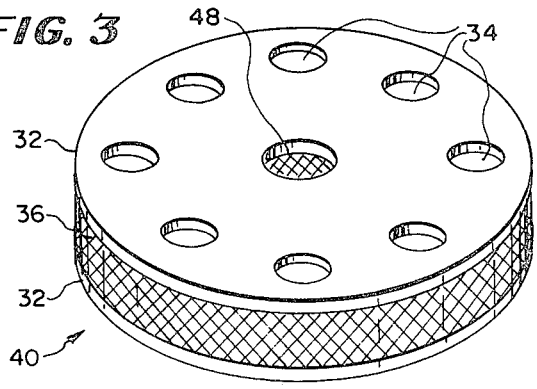
FIG. 3 is a perspective view of the arc gas control device of FIGS. 1 and 2.
Figure 4:
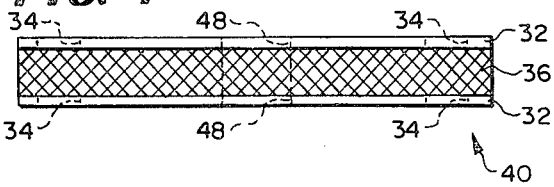
FIG. 4 is an end view of the arc gas control device of FIG. 3.

Referring now to the drawings in greater detail wherein like numerals have been employed throughout the various views to designate similar components, FIG. 1 illustrates a power class fuse designated by the numeral 10. The fuse is installed within wall 20 of an electrical device 12, such as, for example, a transformer which the fuse is to protect from electrical overloads.

Fuse 10 comprises a cylindrical fuseholder or canister 14 and a fuse element assembly 22. Canister 14 has a closed end wall 16 defined by a screw-on cap 17 and an opposite open end 18 communicating with an opening 21 in outside wall 20 of transformer device 12. The interior of device 12 surrounding the fuse 10 is conventionally filled with a dielectric fluid. As such, fuse canister 14 is sealed.

Attached to end cap 17 and extending into the canister 14 from end 16 thereof is a female load break contact 26 of a conventional type. A sleeve 29 of arc-quenching material encases the female load break contact. A terminal 37 connected electrically to contact 26 is located on the outside of end cap 17 for electrical connection of the fuse to the transformer device.

Fuse element assembly 22 is insertable into canister 14 from open end 18 thereof. Fuse element assembly 22 comprises a fuse element 27 having an elongated body. A male load break contact 30 is coupled to the fuse element at the leading end thereof. A sliding contacter 28 is coupled to the fuse element at the opposite end for sliding contacting engagement with stationary contact 35 disposed on the inner surface of canister 14. A pull ring 92, cover 94 and coupling 96 are also provided at the open end of canister 14. Pull ring 92, as is well known in the art, permits the manual insertion and withdrawal of the fuse element assembly 22 into and out of, respectively, canister 14.

In practice, installation of the fuse element assembly is accomplished by the insertion thereof into canister 14 with male load break contact leading. Sliding contacter 28 first engages contact 35 within canister 14. Thereafter, the male load break contact is received in the female load break contact 26 already mounted at closed end 16 of the canister, to complete the electrical circuit through fuse element 27. A terminal 31 on cover 94 of the fuse element assembly is connected electrically to contact 35 and permits external electrical connection to fuse element 27.

Often, upon manual insertion of the fuse element assembly into canister 14 to complete an electrical connection to the transformer device 12, an arc is created upon engagement of the load break contacts. When this occurs, arc gases including contaminants such as hot metallic particles, are emitted into the canister. Even with the provision of arc-quenching encasement 29 about the female load break contact, arc gases can be generated. Containment of the arc gases and contaminants is crucial to the operator inserting the fuse element assembly. Furthermore, the operation of the fuse element could be disrupted if the arc gas contaminants remained unchecked; i.e. electrical flashovers within the canister could occur.

To prevent these problems, control device 40 according to the invention has been provided in the fuse canister 14.

Device 40 includes two parallel, spaced, planar plates 32, each of which defines a plurality of apertures 34. The plates 32 are circular in shape, having a diameter just slightly smaller than the inside diameter of the cylindrical canister 14 so that the device serves as a barrier or partition within the canister. In the case of a fuse canister having a cross-section other than circular, the shape of plates 32 is adjusted accordingly.

Disposed between plates 32 of control device 40 is filter material 36, preferably of closely woven fiberglass mesh, but which can be any suitable non-flammable filter material. Control device 40 also includes a central aperture 48 dimensioned to permit device 40 to be slideably received on male load break contact 30 adjacent fuse element 27. A spacer ring 38 also received on contact 30, locates the device at a predetermined distance from the end of the fuse element. A locking collar 44 slid onto the male load break contact subsequently, secures the device in place. Collar 44 is fixed onto contact 30 by means of a locking screw 45.

In operation, when male load break contact 30 is manually inserted into canister 14, sliding contacter 28 at one end of the fuse element first engages contact 35 within the canister 14. Because the load break contacts have not already been engaged, no electrical circuit is as yet defined through the fuse element. Immediately after contact between contacter 28 and contact 35 has been made, male load break contact 30 engages female load break contact 26. When this occurs, an arc is normally struck therebetween, generating a gaseous suspension of metal vapor, ionized particulate and the like contaminants. The hot arc gases tend to move toward the open end 18 of the canister, producing a back pressure if confined to the contact area and if permitted to move throughout the canister, contaminating the interior of the canister around the fuse element. Back pressure in the canister could cause a danger to the operator inserting the fuse element assembly as well as not permitting the full insertion of the male load break contact into the female contact. Metalized particles, etc., produced in the hot gases could cause internal flashover within the canister.

With control device 40 in place, however, arc gases are permitted to pass through apertures 34 in the barrier, trapping electrically conductive particles in the filter material 36, while the relatively clean gases are permitted to expand along the length of fuse element 27 filling the canister 14 and thereby reducing the back pressure therein. Trapping the conductive particles in the filter material 36 prevents flashovers within the canister.

As mentioned heretofore, in the preferred embodiment of the control device according to the invention, filter material 36 is preferably formed of tightly woven fiberglass but other materials well known in the art may be substituted therefor. If required, arc-quenching material can also incorporated in the filter material 36. Although a single pair of plates 32 is shown in the preferred embodiment of the control device, it is recognized that a plurality of plates 32 and successive layers of filter material 36 may also be employed to further enhance the filtering of the gas flow through device 40. Furthermore, if the filter material used is sufficiently rigid, no supporting plates need be provided.

Removal of the fuse element assembly 22 is accomplished by disengaging cover 94 from canister 14 and slidably withdrawing the fuse element assembly from the canister. Once removed, fuse element 27 may be replaced in a conventional manner.

It can thus be seen that an improved canister type load break fuse has been provided which facilitates expansion of relatively clean gases throughout the entire canister thereof. The control device according to the invention provides pressure relief within the fuse canister with the containment of conductive arc products and particulate to the interior end of the canister at points remote from the operator installing the fuse element.

While a particular embodiment of the present invention has been shown and described, it will be understood that the invention is not limited thereto since many modifications may be made. It is therefore contemplated to cover by the present application any and all such modifications as fall within the true spirit and scope of the appended claims.

I claim:

1. In a high voltage power class fuse comprising a canister of electrical insulating material having a predetermined cross-sectional dimension with an open end and a closed end, a female load break contact mounted at the closed end of said canister and a fuse element assembly dimensioned for insertion into said canister including a fuse element coupled mechanically and electrically to a male load break contact dimensioned for receipt in said female load break contact to complete an electrical connection through said fuse element upon insertion of the fuse element assembly into said canister, the improvement comprising:

control means disposed between said female load break contact and said fuse element for controlling hot arc gases created upon the engagement of said male and female load break contacts, said control means having cross-sectional dimension similar to that of the interior dimension of said canister thereby to form a partition thereacross, said control means comprising filter means having a consistency to permit the passage of arc gases therethrough, into the interior of said canister about said fuse element assembly, while trapping therein electrically conductive particles included in said arc gases.

2. A high voltage power class fuse as claimed in claim 1 wherein said control means further includes plate means defining a plurality of apertures therethough, said plate means being positioned adjacent said filter means to provide support thereto.

3. A high voltage power class fuse as claimed in claim 2 wherein said plate means includes a pair of spaced plates, each of which defines a plurality of apertures therethrough and wherein said filter means is sandwiched between said spaced plates.

4. A power class fuse as claimed in claim 2 wherein said fuse canister is cylindrical in shape and wherein said plate means is circular having a diameter similar to the internal diameter of said canister to form said partition within said canister.

5. A power class fuse as claimed in claim 1 wherein said control means defines an aperture therethrough dimensioned for receipt of said male load break contact and wherein said fuse further includes first spacer means mounted on said male load break contact between said fuse element and said control means for positioning said control means in spaced relation with respect to said fuse element and locking collar means mounted on said male load break contact on the side of said control means opposite said fuse element for securing said control means in position on said male load break contact.

6. A power class fuse as claimed in claim 5 wherein said fuse canister is cylindrical in shape, wherein said control means is circular in shape and wherein said control means defines a central aperture therethrough for receiving said male load break contact.

7. A power class fuse as claimed in claim 1 wherein said filter means includes a fiberglass mesh material.

8. A power class fuse as claimed in claim 6 wherein said fiberglass mesh material further includes arc-quenching means.

* * * * *

UNITED STATES PATENT AND TRADEMARK OFFICE

CERTIFICATE OF CORRECTION

PATENT NO. : 4,320,377

DATED : March 16, 1982

INVENTOR(S) : J. Howard Shaw

It is certified that error appears in the above-identified patent and that said Letters Patent are hereby corrected as shown below:

Col. 6, Claim 8, line 37, "as claimed in Claim 6" should read -- as claimed in Claim 7 --

Signed and Sealed this

*Nineteenth* Day of *April 1983*

[SEAL]

*Attest:*

GERALD J. MOSSINGHOFF

*Attesting Officer*

*Commissioner of Patents and Trademarks*